US007323134B2

(12) United States Patent
Latvaitis et al.

(10) Patent No.: US 7,323,134 B2
(45) Date of Patent: Jan. 29, 2008

(54) METHOD OF FORMING INERT ANODES

(75) Inventors: J. Dean Latvaitis, Maryville, TN (US); Raymond Miller, Lower Burrell, PA (US); Steven A. Czekaj, Pittsburgh, PA (US); Patrick W. Holmes, Huntsville, AL (US)

(73) Assignee: Alcoa, Inc., Pittsburgh, PA (US)

( * ) Notice: Subject to any disclaimer, the term of this patent is extended or adjusted under 35 U.S.C. 154(b) by 667 days.

(21) Appl. No.: 10/405,509

(22) Filed: Apr. 2, 2003

(65) Prior Publication Data

US 2004/0195735 A1 Oct. 7, 2004

(51) Int. Cl.
*B28B 5/00* (2006.01)
*B28B 7/00* (2006.01)

(52) U.S. Cl. ..... 264/635; 264/636; 264/313

(58) Field of Classification Search ..... 264/635, 264/636, 313

See application file for complete search history.

(56) References Cited

U.S. PATENT DOCUMENTS 4,374,761 A 2/1983 Ray
4,623,505 A * 11/1986 Traut ..... 264/570
5,221,542 A * 6/1993 Coetzer ..... 425/436 R
5,279,715 A 1/1994 La Camera et al.
5,728,275 A 3/1998 Twigg
6,126,799 A 10/2000 Ray et al.
6,805,777 B1 * 10/2004 D'Astolfo, Jr. ..... 204/280
6,855,234 B2 * 2/2005 D'Astolfo, Jr. ..... 204/280
6,878,246 B2 * 4/2005 Latvaitis et al. ..... 204/280
2001/0035344 A1 11/2001 D'Astolfo, Jr. et al.

* cited by examiner

*Primary Examiner*—Carlos Lopez
(74) *Attorney, Agent, or Firm*—Greenberg Traurig, LLP

(57) ABSTRACT

A method of making an inert anode (12') for use in an electrochemical cell first provides a hollow shaped mold (12) where a metal mandrel (17') having raised male threads (50) at its top diameter (52) is inserted into the mold (12) and a compressible powder (19, 21) added, then the powder is compressed to form recessed female grooves (70) matching the mandrel threads (50) where the mandrel (17') is engaged and withdrawn along with the compressed powder inert anode after which the mandrel is rotated to unscrew it from the compressed powder and the compressed powder shape is then placed on a tray (27) and heated to sintering temperature.

11 Claims, 4 Drawing Sheets

METHOD OF FORMING INERT ANODES

FIELD OF THE INVENTION

This invention relates to a mandrel and its use in the process of forming unsintered inert anodes used in metal electrolysis processes.

BACKGROUND OF THE INVENTION

A number of metals including aluminum, lead, magnesium, zinc, zirconium, titanium, and silicon can be produced by electrolysis processes. Each of these electrolytic processes preferably employs an electrode having a hollow interior.

One example of an electrolysis process for metal production is the well-known Hall-Heroult process producing aluminum in which alumina disso fluoride bath is electrolyzed at temperatures of about 960° C.-1000° C. As generally practiced today, the process relies upon carbon as an anode to reduce alumina to molten aluminum. Despite the common usage of carbon as an electrode material in practicing the process, there are a number of serious disadvantages to its use, and so, attempts are being made to replace them with inert anode electrodes made of for example a ceramic or metal-ceramic "cermet" material.

Ceramic and cermet electrodes are inert non-consumable and dimensionally stable under cell operating conditions. Replacement of carbon anodes with inert anodes allows a highly productive cell design to be utilized, thereby reducing costs. Significant environmental benefits are achievable because inert electrodes produce essentially no $CO_2$ or fluorocarbon or hydrocarbon emissions. Some examples of inert anode compositions are found in U.S. Pat. Nos. 4,374,761; 5,279,715; and 6,126,799, all assigned to Alcoa Inc.

Although ceramic and cermet electrodes are capable of producing aluminum having an acceptably low impurity content, they are relatively expensive. Also, to save costs most have a hollow interior into which a conductor rod is sintered/sealed in place. These inert anodes are molded, extruded, or preferably isostatically pressed usually at about 30,000 psi around a mandrel, to provide an unsintered green anode, which must be subsequently fired to sinter it. In order to fire it the anode must be placed upside down on a sintering tray. This provides a variety of problems.

In the past, a solid cylindrical mandrel and accompanying flexible mold were used to consolidate ceramic/cermet material into a hollow anode shape through isostatic pressing. After pressing, the mandrel was removed from the anode shape and the shape removed from the mold. The unfired green part was then gripped by a variety of devices and placed upside down (hollow side down) on a firing tray for sintering. After sintering in a kiln, the assembly of an anode was completed. This concept required the use of multiple handling devices.

Sacrificial, extruded, metal anodes have been made with threaded ends machined into their top exterior for insertion into hot water heaters as taught in U.S. Pat. No. 5,728,275 (Twigg). Here, the anode itself is a metal more electropositive than a metal surface to be protected. What is needed here is a metal mandrel for forming ceramic or ceramic metal electrodes where the mandrel is easily inserted, removed and performs multiple functions to allow ease of producing the electrode. It is a main object to provide a new mandrel system and inexpensive process for forming green inert anodes. One example of an inert anode assembly for an aluminum smelting cell is shown in FIG. 3 of U.S. Patent Application Publication 2001/0035344 A1 (D'Astolfo Jr. et al.) where cup shaped anodes are used.

SUMMARY OF THE INVENTION

The above needs are met and object attained by providing a method of forming and firing an inert anode part comprising the steps: (a) providing a compressible hollow inert anode shaped mold having a closed bottom and an opening at the top; (b) inserting a metal mandrel into the center of the hollow inert anode shaped mold and adding compressible powder, selected from the group consisting of ceramic, cermet, metal, and mixtures thereof, into the hollow between the mandrel and the mold, so that the powder surrounds and contacts the bottom and sides of the outside of the mandrel and the inside of the mold, where the mandrel has raised male threads located around its top outside diameter near the opening of the inert anode shaped mold and a top exterior portion not contacting the powder; (c) compressing the powder and inert anode shaped mold causing the powder to compress against the mandrel to form recessed female grooves in the powder, matching the mandrel male threads and engaging the compressed powder to the mandrel forming an inert anode part; and then (d) vertically withdrawing the mandrel and engaged compressed powder inert anode part so that both are removed from the mold, and then (e) gripping the outside diameter of the compressed powder inert anode part and rotating the metal mandrel to unscrew the metal mandrel from the compressed powder inert anode part. The resulting female threads in the compressed powder inert anode part support downstream assembly requirements and eliminate the needs for any machining of the former interior annular groove. While still in the external gripping device, the inert anode part is inverted upside down (hollow side down) and placed on a firing substrate such as a setter tray in a heat source for firing to sinter it. The entire operation is performed at one production center, the inert anode part is manipulated with fewer handling devices, and no ceramic/cermet waste material is generated. The process is simple, less expensive, with a much higher production rate.

The invention also resides in a metal mandrel and attached contacting compacted material where the mandrel has raised male threads running around the upper portion of its outside diameter embedded in the compacted material, where the compacted material comprises inert anode material, where the inert anode material has recessed female grooves matching the mandrel male threads, and where the mandrel can be unscrewed out of the contacting inert anode material. Female internal threads pressed into the top hollow portion of the inert anode are important and necessary for further downstream assembly.

BRIEF DESCRIPTION OF THE DRAWINGS

A full understanding of the invention can be gained from the above and following description when read in conjunction with the accompanying drawings in which.

DETAILED DESCRIPTION OF PREFERRED EMBODIMENTS

Figure 1:
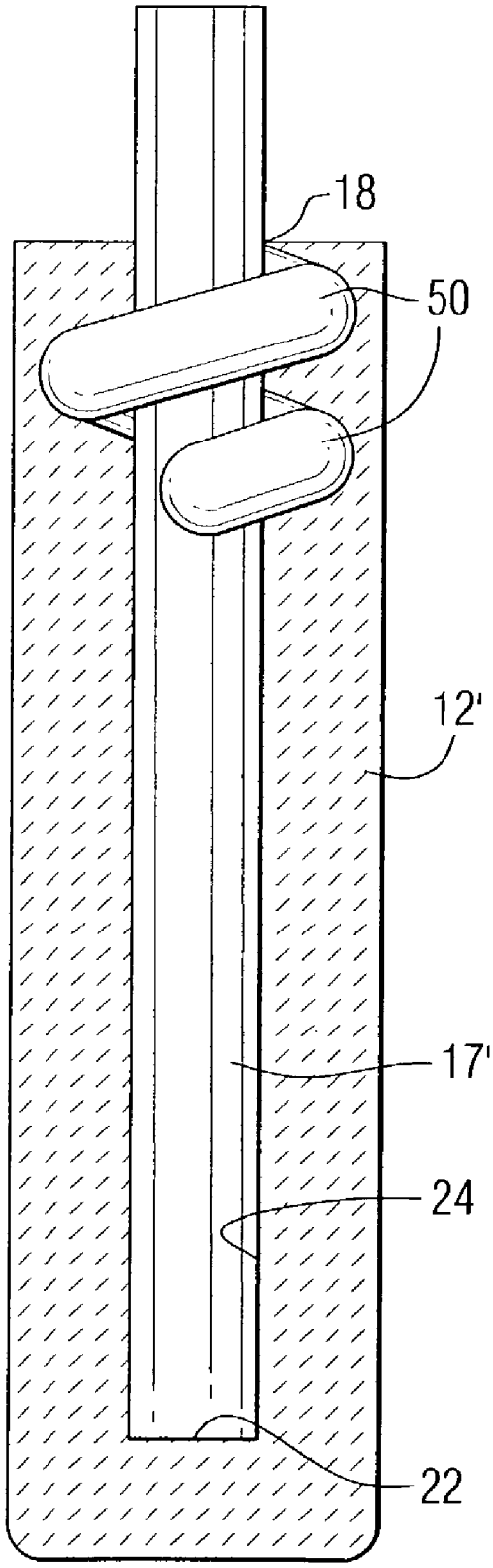
FIG. 1 is a cross sectional view partly in elevation of one embodiment of a round metal mandrel and attached compacted assembly after pressing and before removal of the mandrel.

Referring now to FIG. 1, one embodiment of a mandrel and attached assembly compacted after pressing is shown. Compressed powder of inert anode material is shown as 12'. This powder is at least one of inert ceramic or cermet. A round metal mandrel 17' is shown disposed within the hollow electrode shape 12'. After mandrel removal and compressed powder sintering the inert anode material will be a sintered inert anode. As used herein, the term "inert anode" refers to a substantially non-consumable, non-carbon anode having satisfactory resistance to corrosion and dimensional stability during the metal production process. This can be at least one of a sintered ceramic, cermet (ceramic/metal), or metal material.

Figure 4:
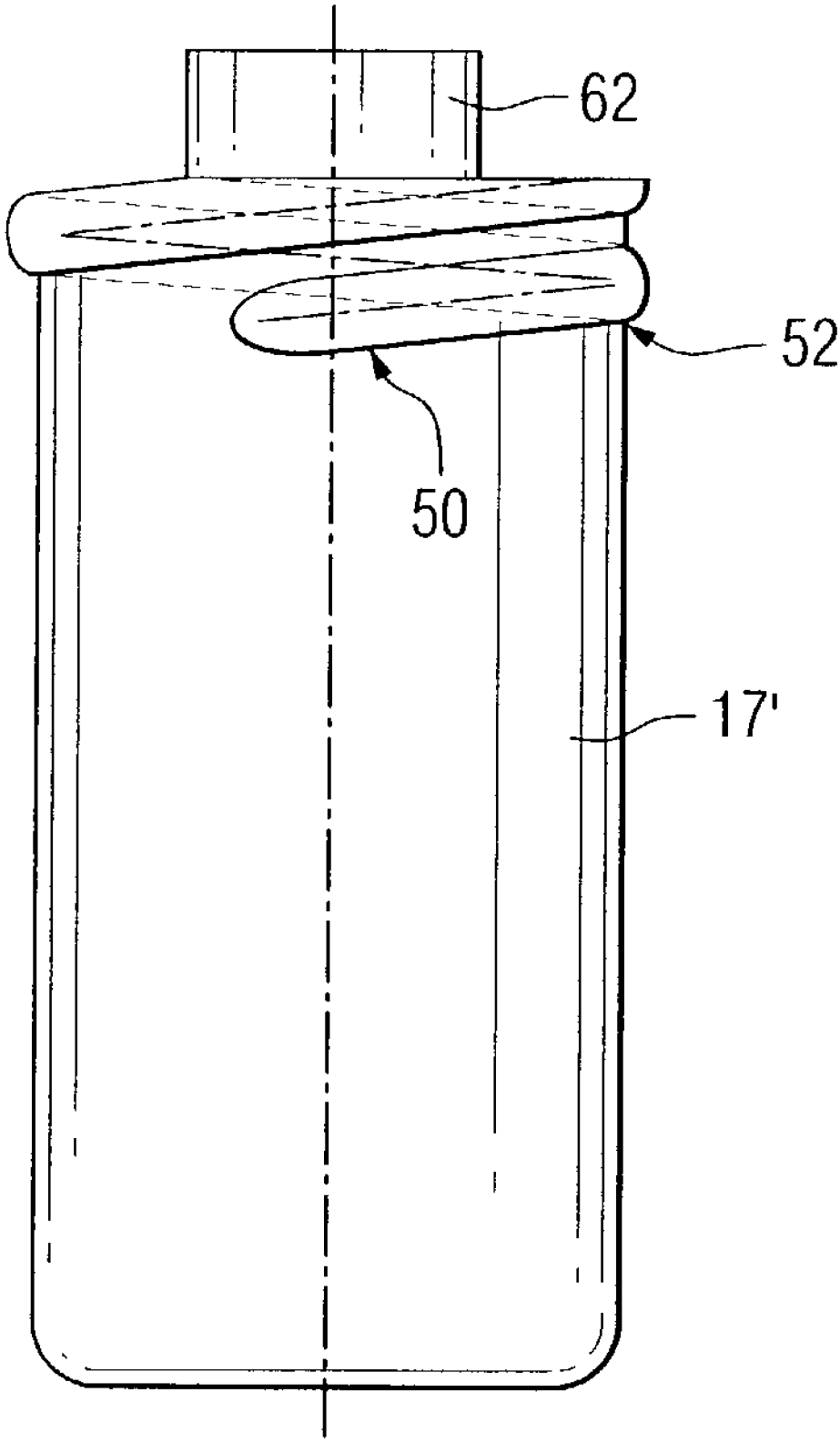
FIG. 4 is a side elevational view of one embodiment of the multipurpose, reusable mandrel of this invention having male threads to engage surrounding filler upon application of pressure.

The hollow, cup type, inert anode shape 12' would have a top 18, a bottom interior wall 22 and side interior walls 24. The inert anode electrode shape 12' is shown after initial forming to a green shape around a mandrel. The mandrel is later removed and the shape fired at from about 1300° C. to 1600° C. to provide a hollow sintered structure into which a conductor rod can be inserted and attached by a variety of means. The mandrel shown in this invention will have male threads 50 as best shown in FIG. 4.

Figure 2A:
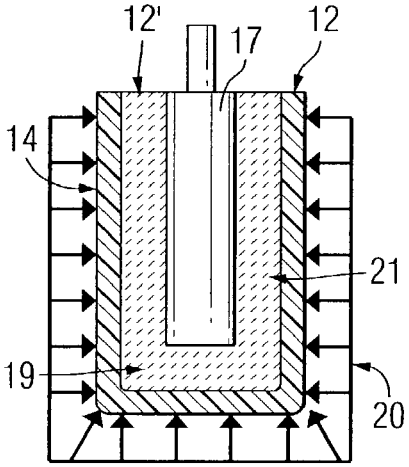
FIG. 2, showing steps 2*a* to 2*e*, are a schematic diagram showing steps of one embodiment of a process for forming green inert anodes requiring several different apparatus.
Figure 2B:
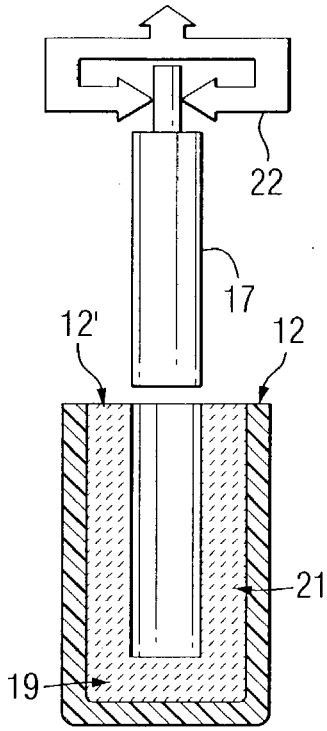
Figure 2C:
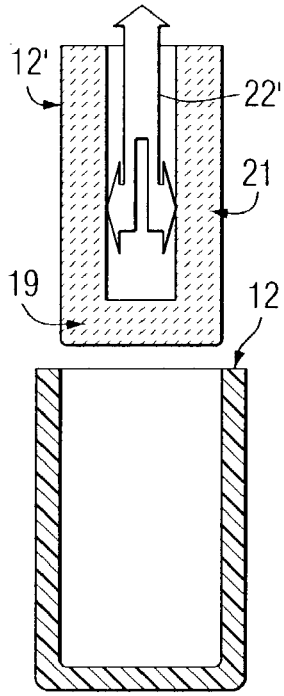
Figure 2D:
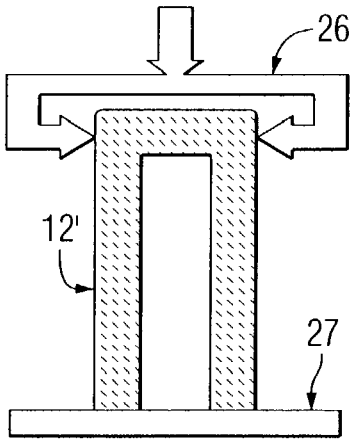
Figure 2E:
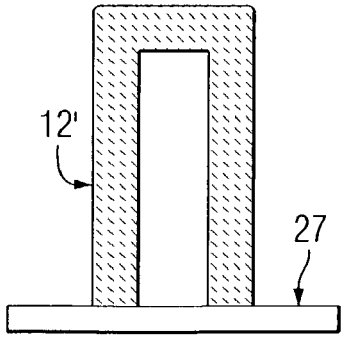

FIGS. 2*a* to 2*e*, which are steps as well as figures, schematically illustrate one process of making the inert anode electrode form 12'. As see in FIG. 2*a*, a smooth surfaced mandrel 17 is placed inside a flexible mold 12, such as high strength polyurethane, on top of ceramic/cermet powder 19. Additional powder 21 is placed around the mandrel in the annular space between the mandrel and the mold. Pressure 20 is then exerted on the outside of the flexible mold, such as by isostatic pressing at from about 20,000 psi to 40,000 psi (137,800 kPa to 206,700 kPa) to form a consolidated compressed ceramic/cermet part. When the pressing cycle is complete and pressure relieved, in FIG. 2*b*, an auxiliary gripping device 22 captures the top of the mandrel and removes it vertically from the bore of the pressed part 12'. In FIG. 2*c*, a different bore gripping device 22' is inserted inside the bore of the part and radially expanded to engage the part bore surface. The device and captured part are then both raised vertically, thereby extracting the compressed ceramic/cermet part from the mold 12. After mold extraction, the part is released from the bore gripping device and transferred as shown in optional step FIG. 2*d*, where the ceramic/cermet part is moved by another gripping device 26, inverting it so that it is open side down, and placed on tray 27. As shown in FIG. 2*e* it is ready for sintering. As can be seen in FIGS. 2*a* to 2*e*, this prior process requires a number of steps, which results in expense, as well as use of complicated apparatus.

Figure 3A:
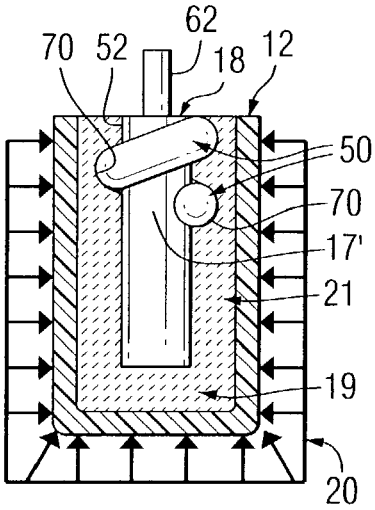
FIG. 3, showing steps 3*a* to 3*e*, are a schematic diagram showing steps of the process of this invention for forming green inert anodes.

In the method of this invention, shown schematically in FIGS. 3*a* to 3*e*, which are steps as well as figures, a round metal mandrel and attached compressed ceramic/cermet powder form are shown in FIG. 3*a*. A mandrel 17', with raised male threads 50 located around its top outside diameter 52, and no moving parts, is used in FIG. 3*a*. One embodiment of this mandrel is shown in detail in FIG. 4, where, as shown the top diameter 52 has raised male threads 50, preferably with a rounded rather than sharp edge, as a rounded edge will cause less possibility of cracking the ceramic/cermet filler 19, 21 under pressure. A stem/top pull member 62 is also shown in FIG. 3*a*-3*e* and FIG. 4.

Referring back now to FIG. 3*a*, recessed, female grooves 70, at the exterior of male threads 50, are pressed into the ceramic/cermet powder 21 near the top part 18 of the mandrel 17' as pressure 20 is applied. In the step shown in FIG. 3*a*, the mandrel is inserted into the center of a flexible mold 12, on top of ceramic/cermet powder 19. Additional powder 21 is placed around the mandrel in the annular space between the mandrel and the mold.

Isostatic pressure 20, in the range of 20,000 psi to 40,000 psi is then applied to the outside of the flexible mold. Subsequent deformation of the flexible mold causes the ceramic/cermet powder to compress against the mandrel to form recessed female grooves 70 in the powder, best shown in FIG. 3*c*, matching the mandrel male threads and engaging the compressed powder to the mandrel.

Figure 3B:
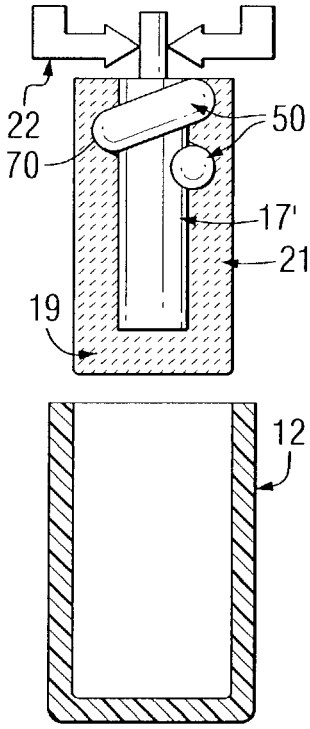
Figure 3C:
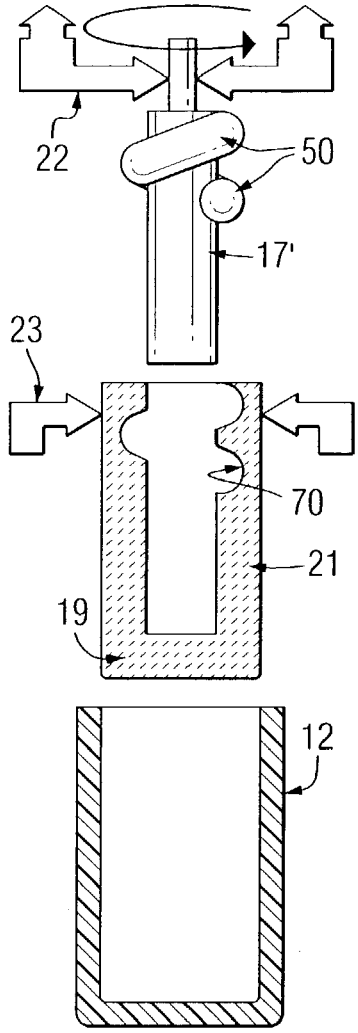
Figure 3D:
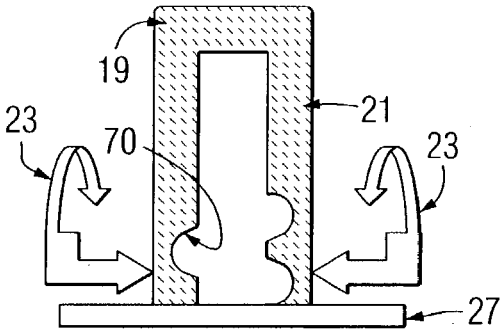
Figure 3E:
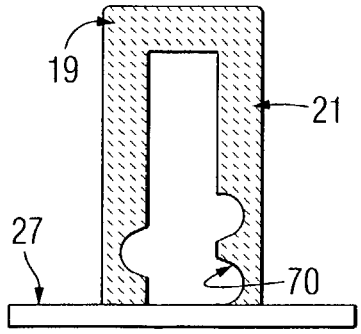

In FIG. 3*b*, after the pressure has been relieved, the exposed top portion of the mandrel is clamped by a gripping device 22. As the device is raised vertically, it removes both the mandrel and engaged pressed ceramic/cermet part, from the mold 12. In FIG. 3*c*, a secondary gripping device 23, captures the outside of the part holding it stationary. Device 22, still clamped to the threaded mandrel, rotates and lifts vertically, simultaneously unthreading/disengaging the mandrel from the pressed ceramic/cermet part. In FIG. 3*d*, gripping device 23, while still capturing the ceramic/cermet part, inverts the part, open side down, and places it onto a tray 27, as shown in FIG. 3*e*, for sintering. The ceramic/cermet inert anode shape on tray 27, is then moved to an oven and sintered.

EXAMPLE

Successful application of a solid metal mandrel with external threads, such as similar to FIG. 4, for forming inert anodes has been demonstrated on a prototype automated cold isostatic pressing complex. The metal mandrel tested ranged from 1.5 in. to 3.0 in (3.05 cm to 7.6 cm) diameter and from 8 in to 10 in (20.3 cm to 25.4 cm) long.

As shown in FIG. 3*a*, step 1, a ceramic/cermet powder was loaded into the inside bottom of a flexible mold; threaded mandrel was then placed on top of the powder and additional powder was added to fill the annulus between the outside of the mandrel and the inside of the mold. The mold/powder/mandrel assembly was then sealed and 20,000 psi-40,000 psi of isostatic pressure applied to the outside of the flexible mold. The flexible mold deformed under pressure, compressing the ceramic/cermet powder against the solid threaded mandrel. The isostatic pressure was relieved and the assembly was unsealed, exposing a consolidated/densified hollow anode shape. Female threads impressed on the inside of the hollow anode shape matched the existing male threads located on the outside of the mandrel.

Then, a mandrel gripping device 22, was clamped onto the top stem 62 of the mandrel and vertically extracted the mandrel 17' and engaged solid anode shape from the flexible mold as shown in FIG. 3*b*.

In step 3, shown as FIG. 3*c*, a pneumatic robotic end effecter encircled the outside diameter of the solid anode shape holding it stationary as a mandrel gripping device unscrewed the mandrel from the solid anode shape by rotating and extracting vertically.

The solid hollow anode shape, still held by end effecter was then inverted and placed on a tray; and subsequently sintered at 1300° C. to 1600° C. to yield an inert anode intact that can be fitted with a pin conductor for use in an aluminum electrolysis cell.

It should be understood that the present invention may be embodied in other forms without departing from the spirit or essential attributes thereof, and accordingly, reference should be made to both the appended claims and to the foregoing specification as indicating the scope of the invention.

What is claimed is:

1. A method of forming an inert anode comprising:

(a) providing a compressible hollow inert anode shaped mold having a closed bottom and an opening at the top;

(b) inserting a metal mandrel into the center of the hollow inert anode shaped mold and adding compressible powder, into the hollow between the mandrel and the mold, so that the powder surrounds and contacts the bottom and sides of the outside of the mandrel and the inside of the mold, said compressible powder being suitable for use as an inert anode, where the mandrel has raised male threads located around its top outside diameter near the opening of the inert anode shaped mold and a top exterior portion not contacting the powder;

(c) compressing the powder and inert anode shaped mold causing the powder to compress against the mandrel to form recessed female grooves in the powder, matching the mandrel male threads and engaging the compressed powder to the mandrel forming a green inert anode;

(d) vertically withdrawing the mandrel and the green inert anode so that both are removed from the mold;

(e) gripping the outside diameter of the green inert anode and rotating the metal mandrel to unscrew the metal mandrel from the green inert anode;

(f) firing the green inert anode at a temperature of between about 1300° C. and 1600° to produce a fired inert anode;

(g) fitting the fired inert anode with a pin conductor; and (h) using the fired inert anode to produce aluminum metal in an aluminum metal electrolysis cell, wherein during the using step, electricity flows from the pin conductor, through the inert anode and into a bath of the aluminum electrolysis cell.

2. The method of claim 1, wherein the interior of the inert anode is not machined after step (e).

3. The method of claim 1, wherein the compression in step (c) is provided by isostatic pressing and the inert anode comprises at least one of a cermet, ceramic or metal material.

4. The method of claim 1, wherein the mandrel has a top stem to allow ease of withdrawal and gripping in steps (d) and (e).

5. A method comprising:

creating a mandrel-powder-mold assembly by;

inserting a mandrel into an anode mold, at least a portion of the mandrel having raised male threads;

filling at least a portion of the anode mold with a compressible powder of a material suitable for use as an anode;

compressing the inert compressible powder in the mandrel-powder-mold assembly to obtain an inert anode body of solidified powder, the inert anode body having an exterior surface defined by the anode mold and an interior surface defined by the metal mandrel, the interior surface including recessed female grooves defined by the raised male threads of the metal mandrel; and firing the green inert anode at a temperature of between about 1300° C. and 1600° to produce a fired inert anode;

fitting the fired inert anode with a pin conductor; and using the fired inert anode to produce aluminum metal in an aluminum metal electrolysis cell, wherein during the using step, electricity flows from the pin connector, into and through the inert anode and into a bath of the aluminum electrolysis cell.

6. The method of claim 5, further comprising:

removing the inert anode body from the anode mold; and removing the mandrel from the inert anode body, thereby creating a void within the anode body.

7. The method of claim 5 wherein the inert compressible powder is selected from a ceramic powder, a cermet powder, a metal powder, and mixtures thereof.

8. The method of claim 6, further comprising:

inserting a conductor rod into the void, the conductor rod being shaped to engage the recessed female grooves of the inert anode body.

9. The method of claim 5, wherein the compressing step further comprises:

applying a pressure of at least about 20,000 pounds per square inch to the inert compressible powder.

10. The method of claim 1, further comprising:

after step (f), inserting a conductor rod into the fired inert anode.

11. The method of claim 10, wherein said inserting step comprises:

attaching said conductor rod to said fired inert anode.

* * * * *

UNITED STATES PATENT AND TRADEMARK OFFICE

CERTIFICATE OF CORRECTION

PATENT NO. : 7,323,134 B2
APPLICATION NO. : 10/405509
DATED : January 29, 2008
INVENTOR(S) : J. Dean Latvaitis et al.

It is certified that error appears in the above-identified patent and that said Letters Patent is hereby corrected as shown below:

Column 1, line 19: replace first occurrence of "C." with "C"

Column 3, line 26: replace "C." with "C"

Column 3, line 27: replace "C." with "C"

Column 5, line 1: replace "C." with "C"

Column 5, line 11, cancel the text beginning with "1. A method of forming" to and ending "electrolysis cell." line 43 and insert the following claim:

--1. A method of forming an inert anode comprising:
(a) providing a compressible hollow inert anode shaped mold having a closed bottom and an opening at the top;
(b) inserting a metal mandrel into the center of the hollow inert anode shaped mold and adding compressible powder, into the hollow between the mandrel and the mold, so that the powder surrounds and contacts the bottom and sides of the outside of the mandrel and the inside of the mold, said compressible powder being suitable for use as an inert anode, where the mandrel has raised male threads located around its top outside diameter near the opening of the inert anode shaped mold and a top exterior portion not contacting the powder;
(c) compressing the powder and inert anode shaped mold causing the powder to compress against the mandrel to form recessed female grooves in the powder, matching the mandrel male threads and engaging the compressed powder to the mandrel forming a green inert anode;
(d) vertically withdrawing the mandrel and the green inert anode so that both are removed from the mold;
(e) gripping the outside diameter of the green inert anode and rotating the metal mandrel to unscrew the metal mandrel from the green inert anode;
(f) firing the green inert anode at a temperature of between about 1300°C and 1600° to produce a fired inert anode;
(g) fitting the fired inert anode with a pin conductor; and
(h) using the fired inert anode to produce aluminum metal in an aluminum metal electrolysis cell, wherein during the using step, electricity flows from the pin conductor, through the inert anode and into a bath of the aluminum electrolysis cell.--

UNITED STATES PATENT AND TRADEMARK OFFICE

CERTIFICATE OF CORRECTION

PATENT NO. : 7,323,134 B2
APPLICATION NO. : 10/405509
DATED : January 29, 2008
INVENTOR(S) : J. Dean Latvaitis et al.

It is certified that error appears in the above-identified patent and that said Letters Patent is hereby corrected as shown below:

Column 6, line 1, cancel the text beginning with "5. A method comprising:" to and ending "electrolysis cell." in column 6, line 26, and insert the following claim:

--5. A method comprising:
creating a mandrel-powder-mold assembly by;
inserting a mandrel into an anode mold, at least a portion of the mandrel having raised male threads;
filling at least a portion of the anode mold with a compressible powder of a material suitable for use as an anode;
compressing the inert compressible powder in the mandrel-powder-mold assembly to obtain an inert anode body of solidified powder, the inert anode body having an exterior surface defined by the anode mold and an interior surface defined by the metal mandrel, the interior surface including recessed female grooves defined by the raised male threads of the metal mandrel; and
firing the green inert anode at a temperature of between about 1300°C and 1600° to produce a fired inert anode;
fitting the fired inert anode with a pin conductor; and
using the fired inert anode to produce aluminum metal in an aluminum metal electrolysis cell, wherein during the using step, electricity flows from the pin connector, into and through the inert anode and into a bath of the aluminum electrolysis cell.--

Signed and Sealed this

Fifteenth Day of December, 2009

David J. Kappos

David J. Kappos
*Director of the United States Patent and Trademark Office*